US008297207B2

(12) United States Patent
Liu

(10) Patent No.: US 8,297,207 B2
(45) Date of Patent: Oct. 30, 2012

(54) RAPIDLY ASSEMBLED OFFICE DESK

(75) Inventor: Yu-Cheng Liu, Kaohsiung (TW)

(73) Assignee: Choice Industries Corp., Kaohsiung (TW)

( * ) Notice: Subject to any disclaimer, the term of this patent is extended or adjusted under 35 U.S.C. 154(b) by 62 days.

(21) Appl. No.: 13/009,852

(22) Filed: Jan. 20, 2011

(65) Prior Publication Data

US 2012/0186500 A1 Jul. 26, 2012

(51) Int. Cl.
*A47B 3/00* (2006.01)

(52) U.S. Cl. ..... 108/115

(58) Field of Classification Search ..... 108/115, 108/132, 131, 133, 123, 124, 118; 248/188.1, 248/188.7, 188.6, 434, 439, 371, 166
See application file for complete search history.

(56) References Cited

U.S. PATENT DOCUMENTS

| | | | | | |
|---|---|---|---|---|---|
| 489,369 | A * | 1/1893 | Case | 108/124 |
| 3,722,702 | A * | 3/1973 | Marker, Jr. | 108/115 |
| 4,196,675 | A * | 4/1980 | Cook | 108/124 |
| 5,337,657 | A * | 8/1994 | Diffrient | 108/115 |
| 5,927,214 | A * | 7/1999 | Schwartz et al. | 108/128 |
| 6,082,838 | A * | 7/2000 | Bissu-Palombo | 108/115 |
| 6,164,217 | A * | 12/2000 | Prendergast | 108/115 |
| 6,314,892 | B1 * | 11/2001 | Favini | 108/115 |
| 6,637,352 | B1 * | 10/2003 | Thode et al. | 108/132 |
| 6,845,723 | B2 * | 1/2005 | Kottman et al. | 108/132 |
| 6,997,115 | B2 * | 2/2006 | Lockwood et al. | 108/115 |
| 7,634,968 | B2 * | 12/2009 | Cornelius | 108/115 |
| 7,878,128 | B2 * | 2/2011 | Watson et al. | 108/132 |
| 8,069,795 | B1 * | 12/2011 | Williams et al. | 108/115 |
| 8,091,488 | B2 * | 1/2012 | Chirea et al. | 108/115 |
| 2003/0024444 | A1 * | 2/2003 | Welch et al. | 108/115 |
| 2003/0177960 | A1 * | 9/2003 | Schenker et al. | 108/115 |
| 2004/0094075 | A1 * | 5/2004 | Norstad | 108/115 |
| 2007/0209559 | A1 * | 9/2007 | Mockel | 108/115 |
| 2007/0261611 | A1 * | 11/2007 | Kumazawa | 108/115 |
| 2008/0295742 | A1 * | 12/2008 | Henriott | 108/6 |
| 2010/0258042 | A1 * | 10/2010 | Rutz | 108/115 |
| 2011/0139042 | A1 * | 6/2011 | Korb | 108/115 |

* cited by examiner

*Primary Examiner* — Jose V Chen
(74) *Attorney, Agent, or Firm* — Leong C. Lei

(57) ABSTRACT

A rapidly assembled office desk is provided, wherein a leg and a front guard board of the office desk are respectively fixed through a hinge, so that the leg of the office desk is linked with the front guard board. An inner side of the front guard board of the office desk and a back face of the desk board of the office desk are respectively fixed through a slide rail device, so that the front guard board of the office desk is linked with the desk board. In this way, the front guard board can be unfolded or be folded for storage at the back face of the desk board, and the two legs can also be unfolded or be folded for storage at the inner side of the front guard board.

9 Claims, 12 Drawing Sheets

RAPIDLY ASSEMBLED OFFICE DESK

BACKGROUND OF THE INVENTION (a) Technical Field of the Invention

The present invention relates to a rapidly assembled office desk. More particularly, the present invention relates to an office desk capable of being assembled and being folded for storage rapidly.

(b) Description of the Prior Art

As shown in FIG. 1, a common office desk 1 at least has two legs 11, a desk board 12 and a front guard board 13. Upper supports 111 of the two legs 11 are joined to a back face of the desk board 12 by using a screwing element A. Moreover, the front guard board 13 is also joined respectively to the middle supports 112 of the two legs 11 by using the screwing element A.

Although the purpose of joining each component of the office desk 1 together has been achieved, the legs 11, the desk board 12 and the front guard board 13 are screwed and locked through the screwing element A. After a skilled producer assembles the office desk 1 in a factory, the subsequent packing and transportation of the office desk 1 are very inconvenient due to its extremely large bulk. Moreover, if the office desk 1 is transported to a site of a common consumer and then is joined in the above joining manner, a difficult operation due to the extremely large bulk and a lack of operation proficiency may cause much trouble to the consumer when the consumer assembles it.

SUMMARY OF THE INVENTION

The present invention mainly aims to overcome the problem that a conventional office desk cannot be easily packed or transported due to its extremely large bulk or a common consumer cannot easily assemble the office desk by himself/herself after it is taken apart.

Accordingly, the present invention provides a rapidly assembled office desk, wherein a leg and a front guard board of the office desk are respectively fixed through a hinge, so that the leg of the office desk is linked with the front guard board of the office desk and thus the leg can achieve an operation function of being unfolded and being folded for storage. Moreover, an inner side of the front guard board of the office desk and a back face of a desk board of the office desk are respectively fixed through a slide rail device, so that the front guard board of the office desk is linked with the desk board of the office desk and thus the front guard board can achieve an operation function of being unfolded and being folded for storage. In this way, the front guard board can be unfolded or be folded for storage at the back face of the desk board, and the two legs can also be unfolded or be folded for storage at the inner side of the front guard board. Therefore, the present invention can achieve an operation function of being easily and rapidly assembled and folded for storage, thereby facilitating packing and transportation for a producer and assembling for a consumer himself/herself.

DETAILED DESCRIPTION OF THE PREFERRED EMBODIMENTS

Figure 1:
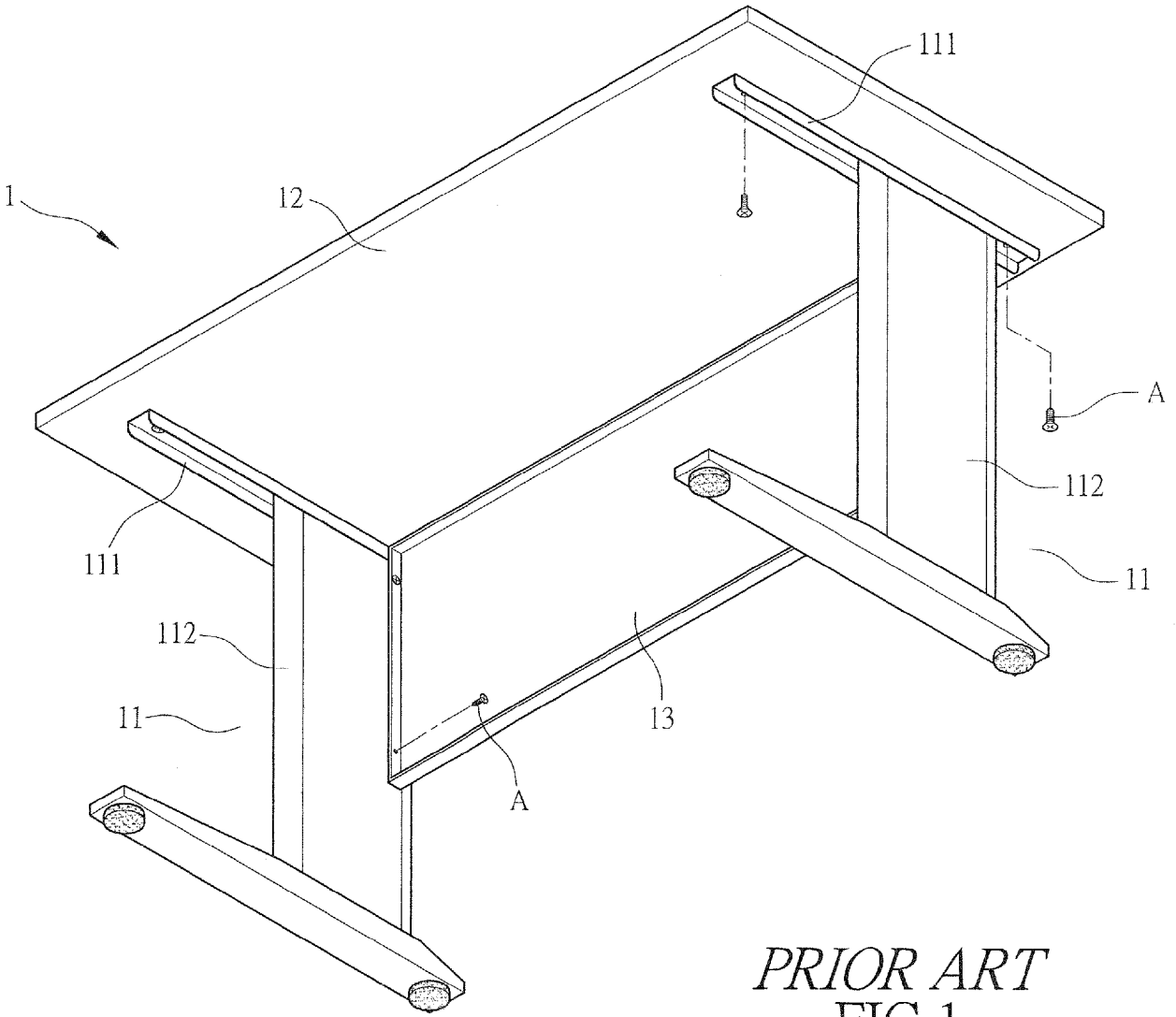
PRIOR ART FIG.1
FIG. 1 is a schematic diagram of a conventional office desk.
Figure 2:
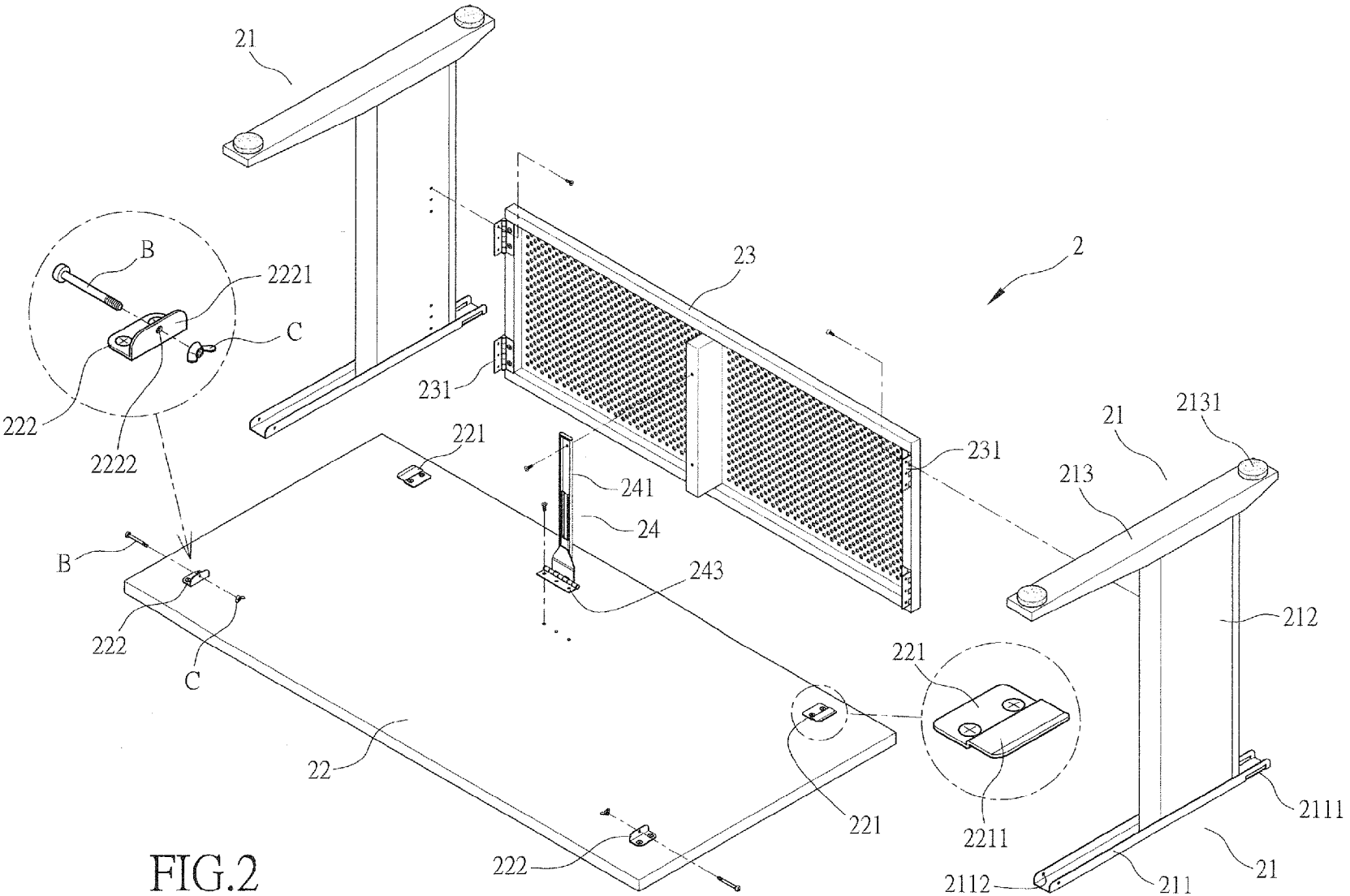
FIG. 2 is an exploded diagram of an office desk of the present invention.

First of all, as shown in FIG. 2, a rapidly assembled office desk 2 of the present invention at least includes two legs 21, a desk board 22, a front guard board 23 and a slide rail device 24.

Each of the two legs 21 has an upper support 211, a middle support 212 and a lower support 213. A front end of the upper support 211 of the leg 21 has at least one groove 2111, and a slot 2112 is disposed at a back end of the upper support 211. Two ends of the middle support 212 are respectively joined to the upper support 211 and the lower support 213. A pad 2131 is disposed on the lower support 213 for a convenient contact with a floor. The pad 2131 further has a structural function of adjusting the height, so that the height of the office desk 2 can further be adjusted to keep horizontal.

A first joining member 221 and a second joining member 222 are fixed to two sides of the back face of the desk board 22. The first joining member 221 is fixed to the back face of the desk board 22 corresponding to the inner side after the upper supports 211 of the two legs 21 are unfolded. The first joining member 221 has an engagement sheet 2211, and a front edge of the engagement sheet 2211 further protrudes outward slightly. The second joining member 222 is fixed to the back face of the desk board 22 corresponding to the outer side after the upper supports 211 of the two legs 21 are unfolded. The second joining member 222 has a linking sheet 2221 substantially perpendicular to the desk board 22, and the linking sheet 2221 has a through hole 2222.

The front guard board 23 is a slab.

The slide rail device 24 has a fixed seat 241 and a slide rail 242 capable of sliding in the fixed seat 241. The slide rail 242 is disposed with a hinge 243 at an end outside of the fixed seat 241, and the slide rail device 24 is preferably a ball bearing slide.

Figure 3:
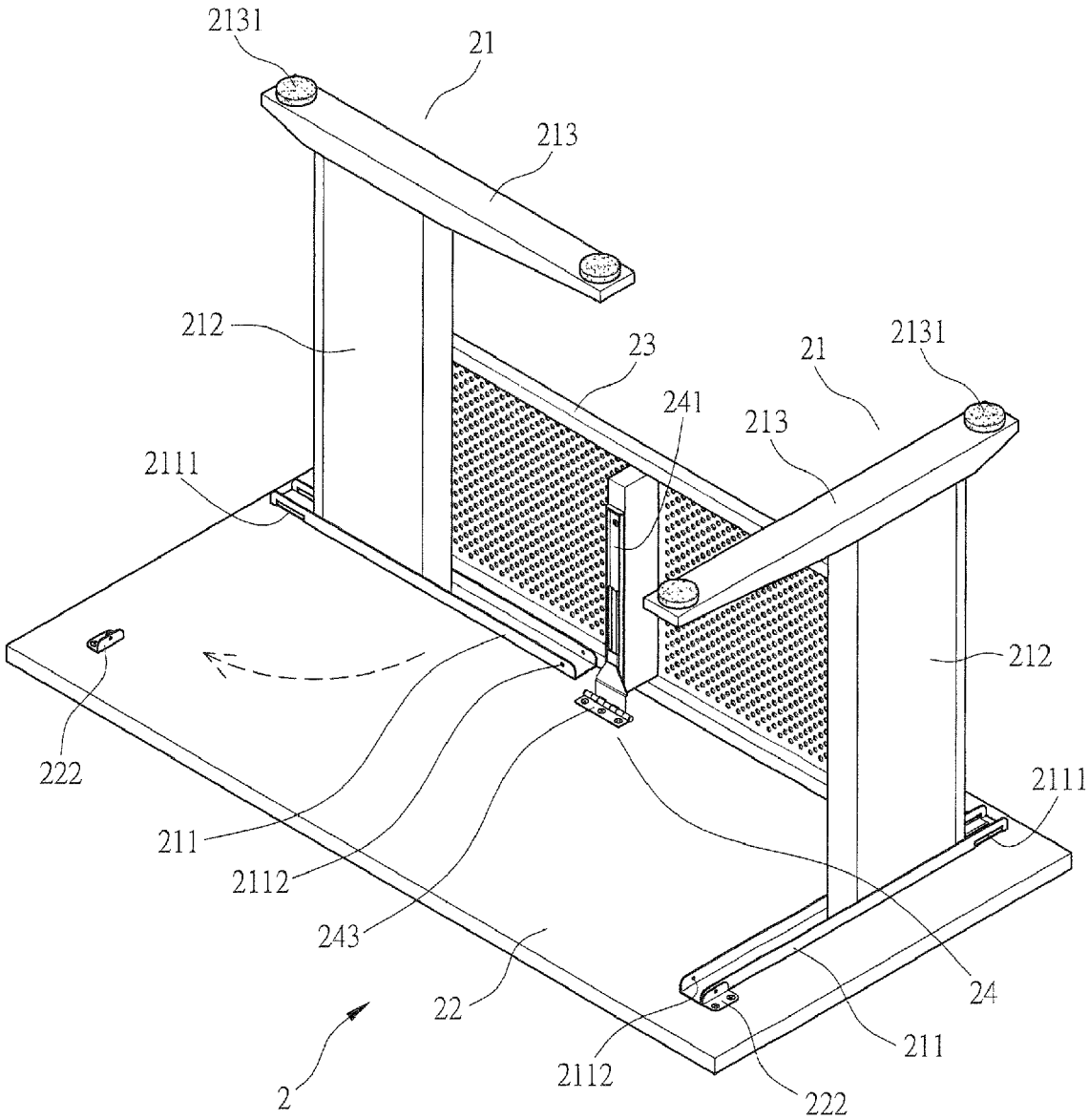
FIGS. 3-4 are schematic diagrams of assembling of an office desk of the present invention.
Figure 4:
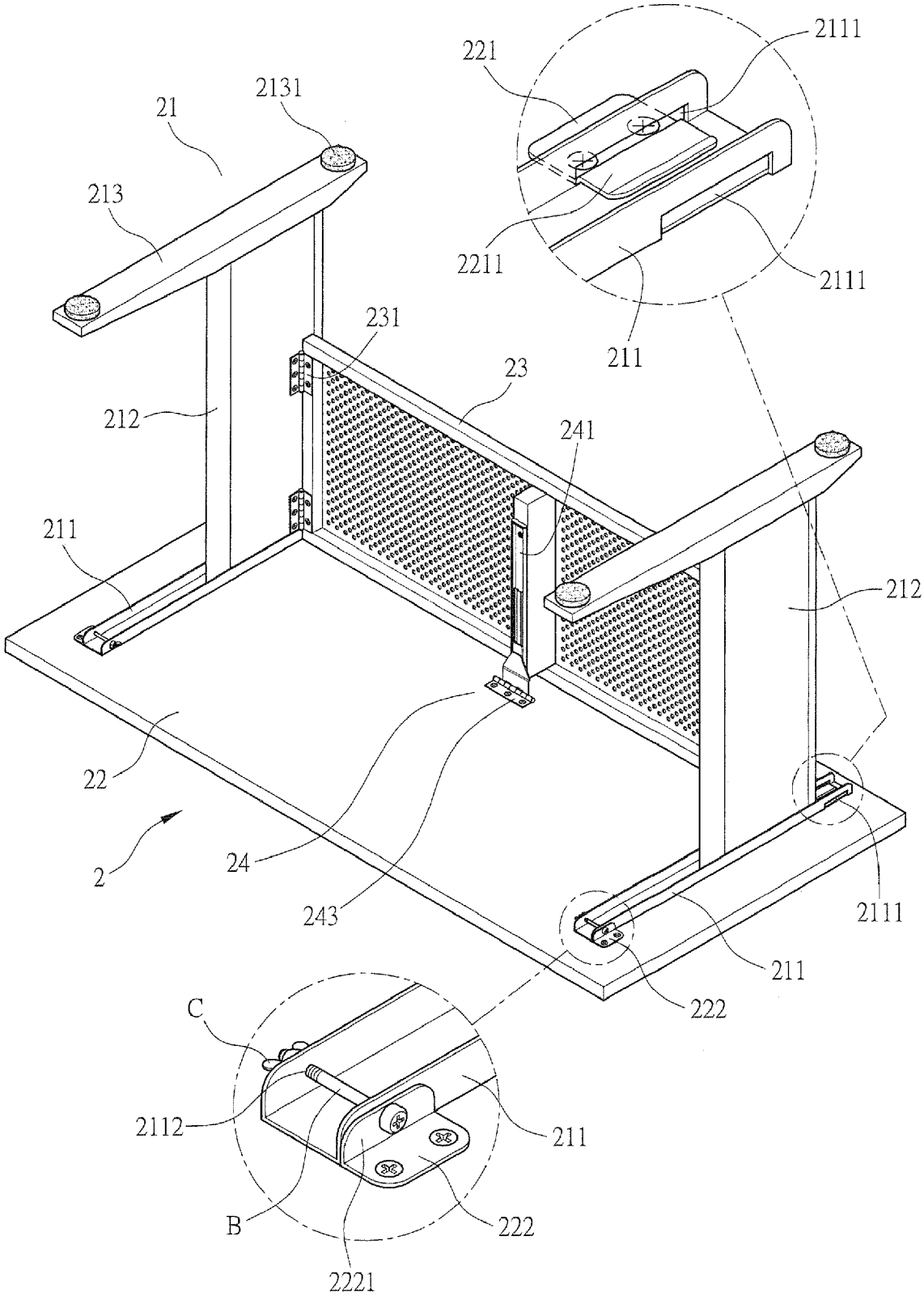
Figure 5:
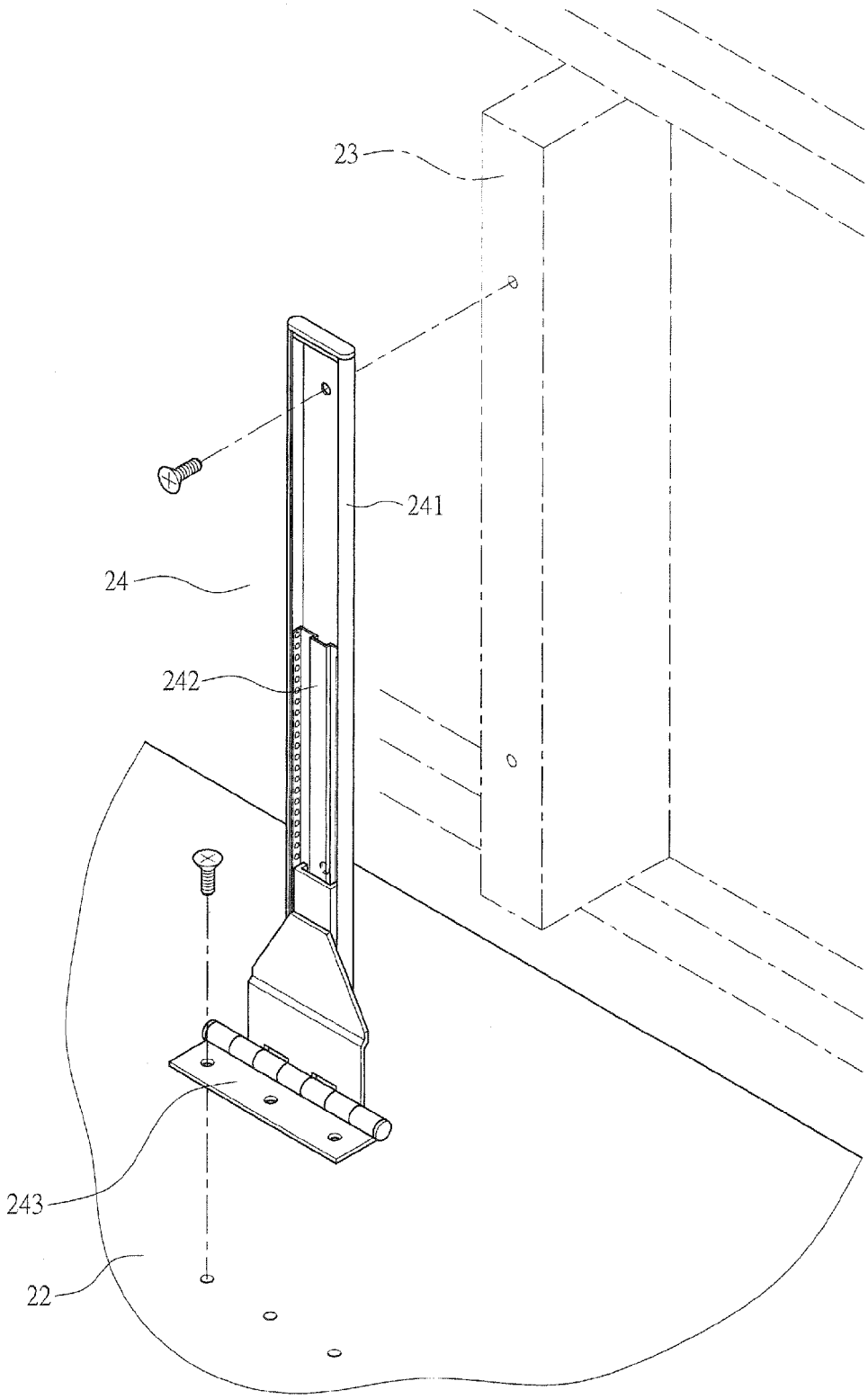
FIG. 5 is a schematic diagram of assembling of a slide rail device in an office desk of the present invention.

Referring to FIGS. 3-5, when each component of the present invention is assembled, the front guard board 23 and the middle supports 212 of the two legs 21 are respectively fixed through at least one hinge 231, so that the front guard board 23 is further linked with the two legs 21. In this way, an operation function of unfolding the two legs 21 and folding them for storage through the hinges 231 can be achieved. Moreover, the fixed seat 241 of the slide rail device 24 is fixed to an inner side of the front guard board 23, and the hinge 243 of the slide rail 242 in the slide rail device 24 is fixed to the back face of the desk board 22. In this way, the front guard board 23 is further linked with the desk board 22, and thus an operation function of unfolding the front guard board 23 and folding it for storage through the slide rail device 24 can be achieved.

Figure 6:
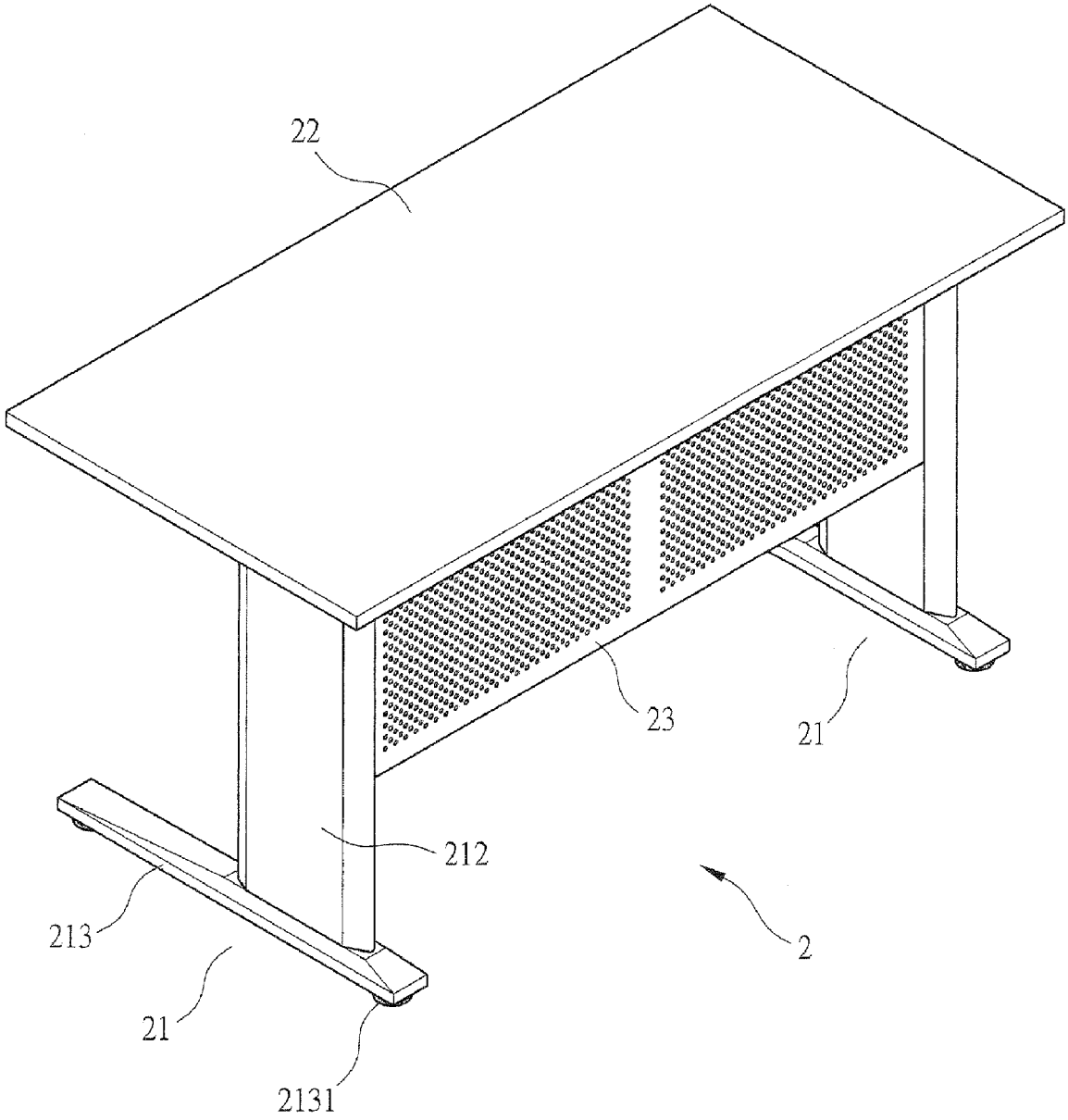
FIG. 6 is a schematic diagram of an office desk of the present invention after being assembled and erected.

When it is intended to assemble the present invention for use, the two legs 21 can be respectively unfolded towards the two outer sides of the desk board 22 through a design of the hinge 231. In this case, the upper supports 211 of the legs 21 are unfolded along the back face of the desk board 22 in a sector shape by taking the hinge 231 as a center, until the inner side and the outer side of the upper support 211 of the leg 21 respectively reach the first joining member 221 and the second joining member 222 fixed to the back face of the desk board 22 at the same time. Accordingly, the engagement sheet 2211 of the first joining member 221 of the desk board 22 just can be embedded in the groove 2111 at the front end of the upper support 211 of the leg 21, so as to position and join both the desk board 22 and the leg 21. Moreover, the front edge of the engagement sheet 2211 of the first joining member 221 protrudes outward slightly, which helps to guide the engagement sheet 2211 to be embedded into the groove 2111. Meanwhile, the outer side at the back end of the upper support 211 of the leg 21 also rests against the linking sheet 2221 of the second joining member 222 of the desk board 22. Then, a bolt B can pass through the slot 2112 at the back end of the upper support 211 and the through hole 2222 of the second joining member 222 of the desk board 22, and work with a nut C for screwing and locking, so as to fix and join the upper support 211 and the desk board 22. After completing the above operations, the office desk 2 of the present invention can be assembled easily and rapidly. The office desk of the present invention can be used when it is inverted with the desk board 22 facing up and the legs 21 standing on the floor, as shown in FIG. 6.

Figure 7:
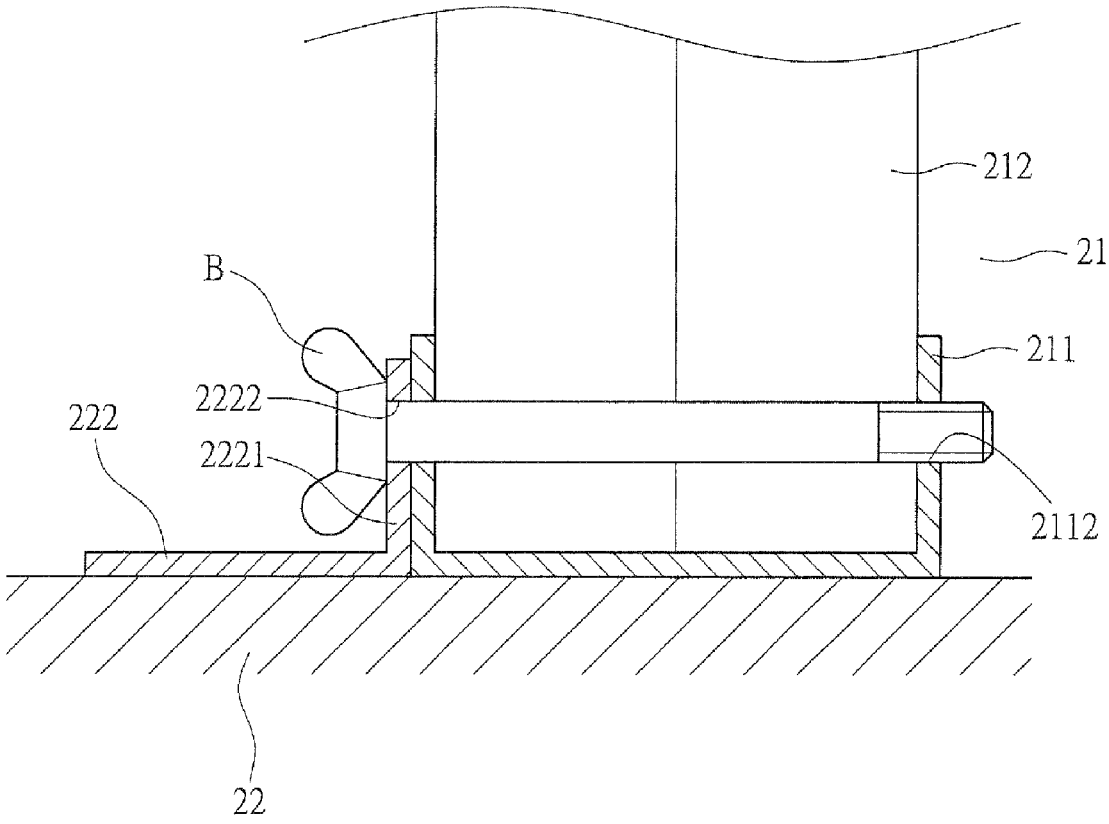
FIG. 7 shows a further embodiment of joining between a leg and a second joining member of an office desk of the present invention.
Figure 8:
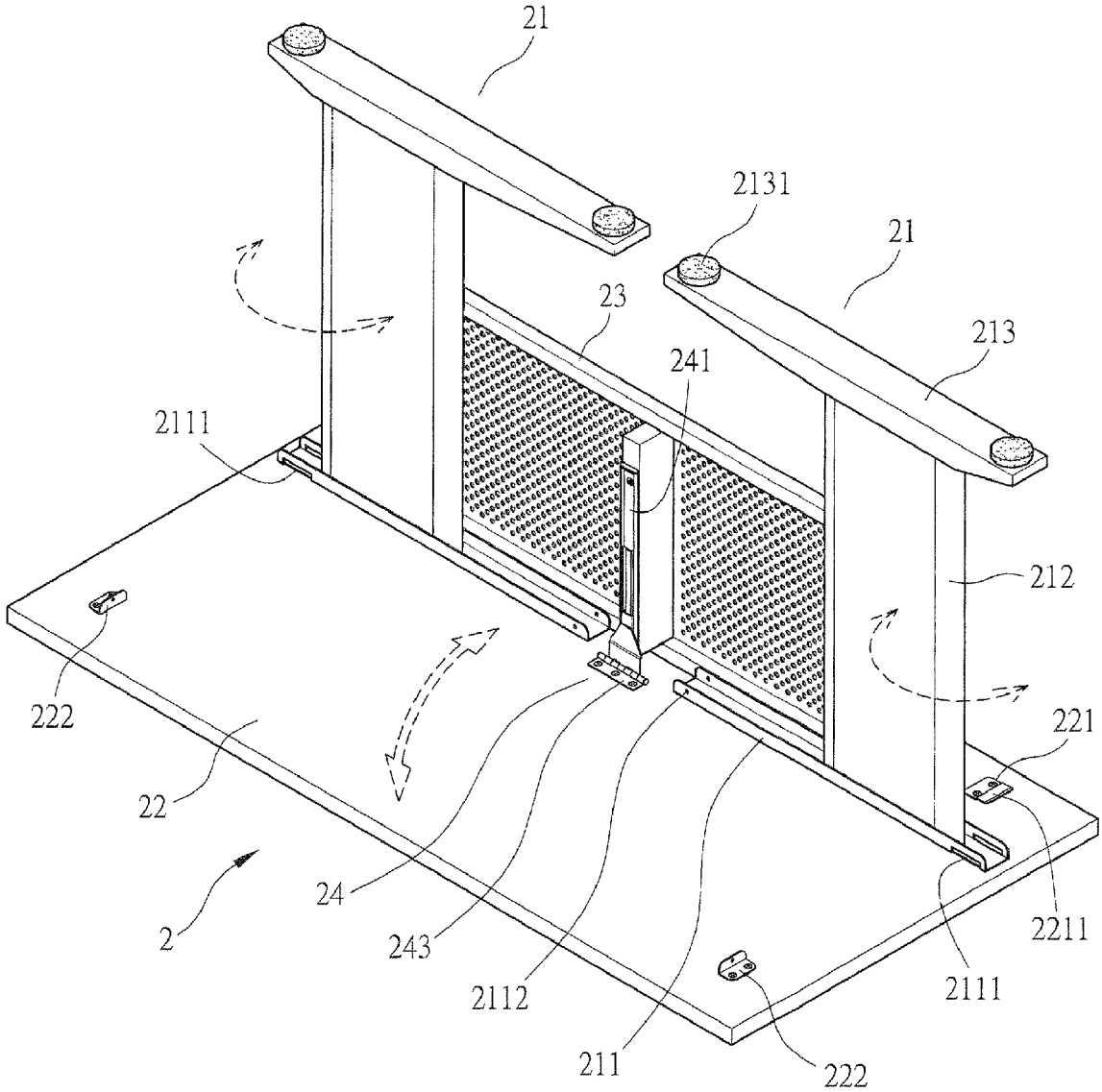
FIGS. 8-12 are schematic operation diagrams of folding an office desk of the present invention for storage.
Figure 9:
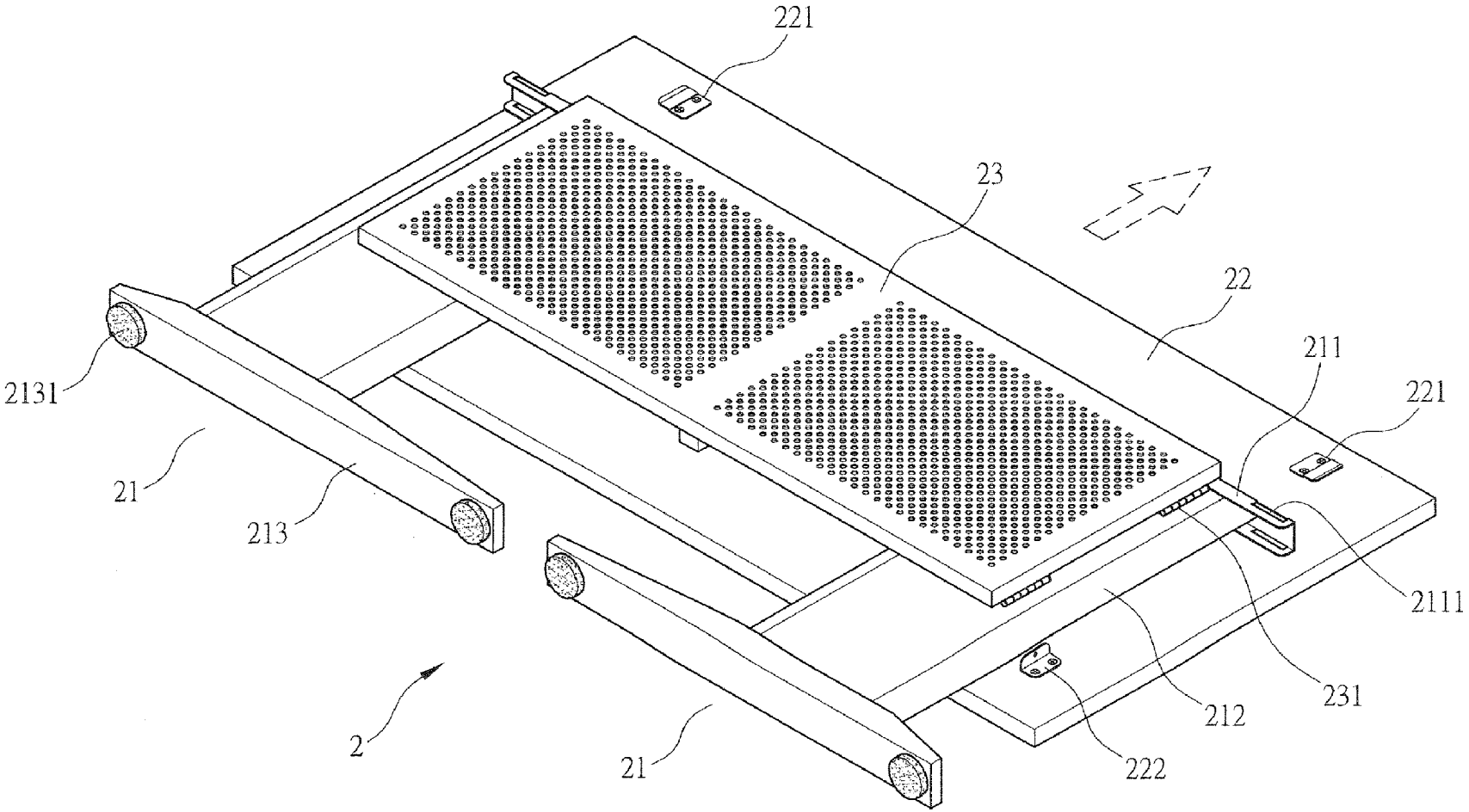
Figure 10:
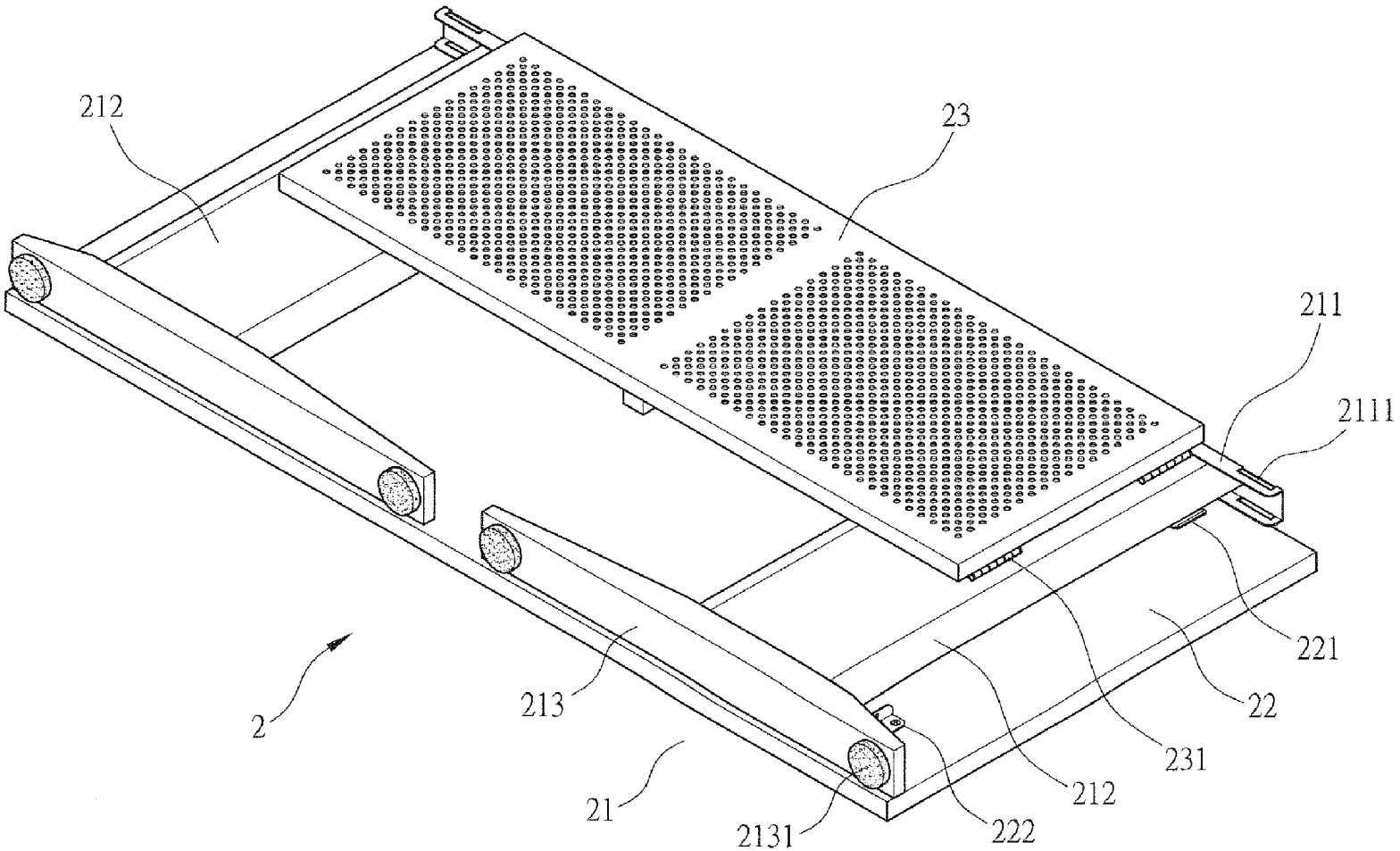
Figure 11:
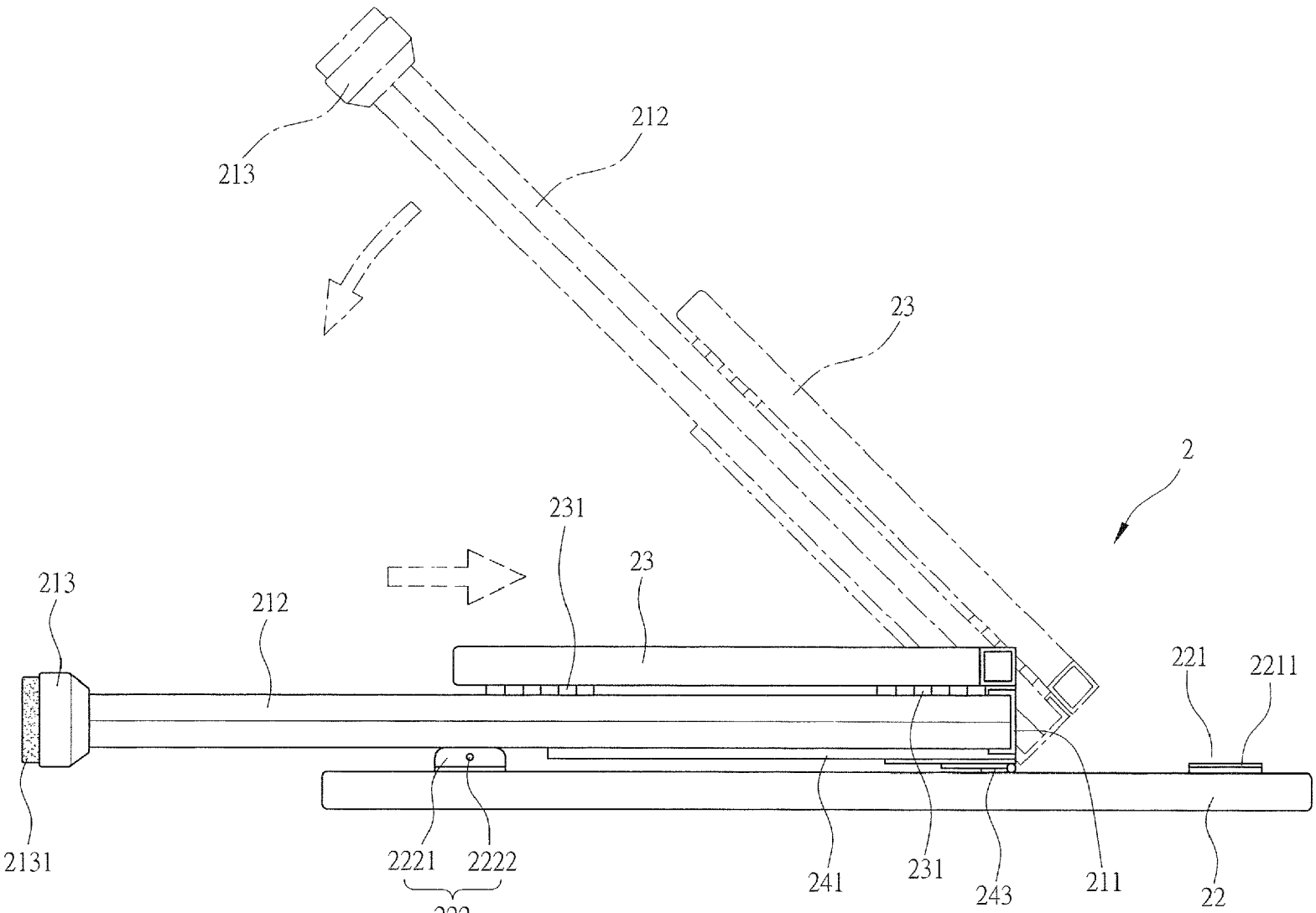
Figure 12:
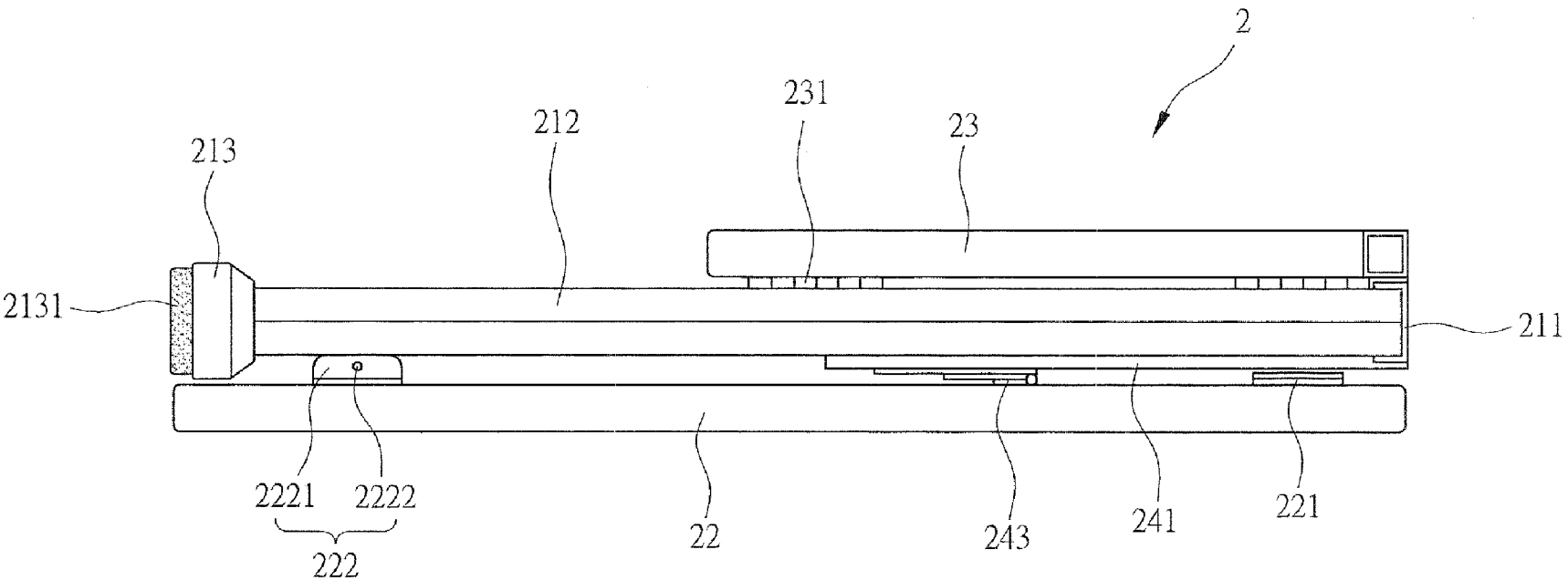

Certainly, a wall of the slot 2112 at the back end of the upper support 211 may be formed with a tooth thread to work with the bolt B for direct screwing and locking, so that the legs 21 can also be joined to the second joining member 222, as shown in FIG. 7.

Referring to FIGS. 8-12, in order to store away the office desk of the present invention, at first, the bolt B screwed between the upper support 211 of the leg 21 and the second joining member 222 of the desk board 22 is removed. Then, the two legs 21 can be bent towards the center of the desk board 22 through the hinge 231 between the front guard board 23 and the two legs 21. In this case, the two legs 21 are folded for storage along the back face of the desk board 22 in a sector shape by taking the hinge 231 as a center, and the front ends of the upper supports 211 of the two legs 21 are disengaged from the first joining member 221 of the desk board 22, until the two legs 21 cling to the inner side of the front guard board 23. Afterwards, through the hinge 243 disposed in the slide rail device 24, the front guard board 23 together with the two legs 21 can be bent and folded for storage towards the back face of the desk board 22, until the two legs 21 cling to the back face of the desk board 22. Finally, after the fixed seat 241 of the slide rail device 24 is fixed to the inner side of the front guard board 23 and the hinge 243 of the slide rail 242 in the slide rail device 24 is fixed to the back face of the desk board 22, the front guard board 23 together with the two legs 21 can be easily pushed to the front end of the desk board 22 through the slide rail device 24, so as to be positioned. When the present invention is folded for storage, it is preferable that the upper supports 211 of the two legs 21 does not extend outside of the front edge of the desk board 22 and the lower supports 213 of the two legs 21 does not extend outside of the back edge of the desk board 22

The features of the present invention lie in the joining between the legs 21 and the front guard board 23 through the hinge 231 and the joining between the front guard board 23 and the desk board 22 through the slide rail device 24. Through the joining of each component, the legs 21, the desk board 22 and the front guard board 23 of the present invention can be unfolded or folded for storage, thus facilitating easy and rapid assembling and storage of the office desk 2 and providing a simple operation procedure of packing and transportation for a producer as well as a simple operation procedure of assembling and using for a consumer.

I claim:

1. A rapidly assembled office desk, at least comprising:

two legs, each having an upper support, a middle support and a lower support, wherein a front end of the upper support has at least one groove, a slot is disposed at a back end of the upper support, two ends of the middle support are respectively joined to the upper support and the lower support;

a desk board, wherein a first joining member and a second joining member are respectively fixed to two sides of a back face of the desk board;

a front guard board, which is a slab, the front guard board having an inner side provided with hinges;

a slide rail device, which has a fixed seat and a slide rail capable of sliding in the fixed seat, wherein the slide rail is disposed with a hinge at an end outside of the fixed seat;

wherein, by fixing the hinges of the front guard board to the middle supports of the two legs, the two legs are linked with the front guard board, so that the two legs can be unfolded and be folded for storage through the hinges; moreover, the fixed seat of the slide rail device is fixed to an inner side of the front guard board, and the hinge of the slide rail in the slide rail device is fixed to the back face of the desk board, so that the front guard board is linked with the desk board and thus the front guard board is capable of being unfolded and folded for storage through the slide rail device.

2. The rapidly assembled office desk of claim 1, wherein a pad is disposed at a contact area between the lower support of the leg and a floor.

3. The rapidly assembled office desk of claim 1, wherein the slot at the back end of the upper support of the leg is formed with a tooth thread.

4. The rapidly assembled office desk of claim 1, wherein the first joining member is fixed to the back face of the desk board corresponding to the inner side after the upper support of the leg is unfolded.

5. The rapidly assembled office desk of claim 1, wherein the second joining member is fixed to the back face of the desk board corresponding to the outer side after the upper support of the leg is unfolded.

6. The rapidly assembled office desk of claim 5, wherein the second joining member has a linking sheet substantially perpendicular to the desk board.

7. The rapidly assembled office desk of claim 6, wherein the linking sheet has a through hole.

8. The rapidly assembled office desk of claim 1, wherein the first joining member has an engagement sheet.

9. The rapidly assembled office desk of claim 8, wherein a front edge of the engagement sheet of the first joining member extends outward slightly.

* * * * *